US006776068B2

(12) United States Patent
Reuschel et al.

(10) Patent No.: US 6,776,068 B2
(45) Date of Patent: Aug. 17, 2004

(54) VALVE OPERATOR

(75) Inventors: William Reuschel, Latham, KS (US); Chris Snyder, Wichita, KS (US)

(73) Assignee: WM. F. Hurst Co., Inc., Wichita, KS (US)

( * ) Notice: Subject to any disclaimer, the term of this patent is extended or adjusted under 35 U.S.C. 154(b) by 0 days.

(21) Appl. No.: 10/065,000

(22) Filed: Sep. 6, 2002

(65) Prior Publication Data

US 2004/0045414 A1 Mar. 11, 2004

(51) Int. Cl.[7] ..... B25B 21/00

(52) U.S. Cl. ..... 81/54; 81/55; 81/57; 81/57.32

(58) Field of Search ..... 81/54, 55, 57, 81/57.32, 57.33, 177.1, 177.2, 177.5, 177.85, 57.36, 57.39, 57.4; 251/293, 292; 173/213, 164

(56) References Cited

U.S. PATENT DOCUMENTS 3,768,775 A * 10/1973 Archer ..... 251/230
4,815,345 A * 3/1989 Radice ..... 81/57.3
5,570,581 A * 11/1996 Preston ..... 60/483
5,638,590 A * 6/1997 Silano ..... 29/254
6,354,178 B2 * 3/2002 Pool et al. ..... 81/463
6,364,285 B1 * 4/2002 Stinnett ..... 251/293

OTHER PUBLICATIONS

Joseph G. Pollard Company, Inc., website article entitled "P/2 Portable Valve Operator", depicting prior art device (published Jul. 23, 2002 or earlier on Pollardwater.com website).

Joseph G. Pollard Company, Inc., website article entitled "TM7 Valve Operator", depicting prior art device (published Jul. 23, 2002 or earlier on Pollardwater.com website).

Joseph G. Pollard Company, Inc., website article entitled "Turn–n–Count Valve & Hydrant Key", depicting prior art device (published Jul. 23, 2002 or earlier on Pollardwater.com website).

E.H. Wachs Companies, "Truck Mounted Valve Operator Model TM–7" (Operating Manual), (Apr., 1998).

* cited by examiner

*Primary Examiner*—Hadi Shakeri
(74) *Attorney, Agent, or Firm*—Hovey Williams LLP

(57) ABSTRACT

Valve operator having a weighted powering assembly that is substantially supported and balanced on a generally upright elongated key that drivingly engages a rotatable valve nut.

27 Claims, 3 Drawing Sheets

FIG. 2
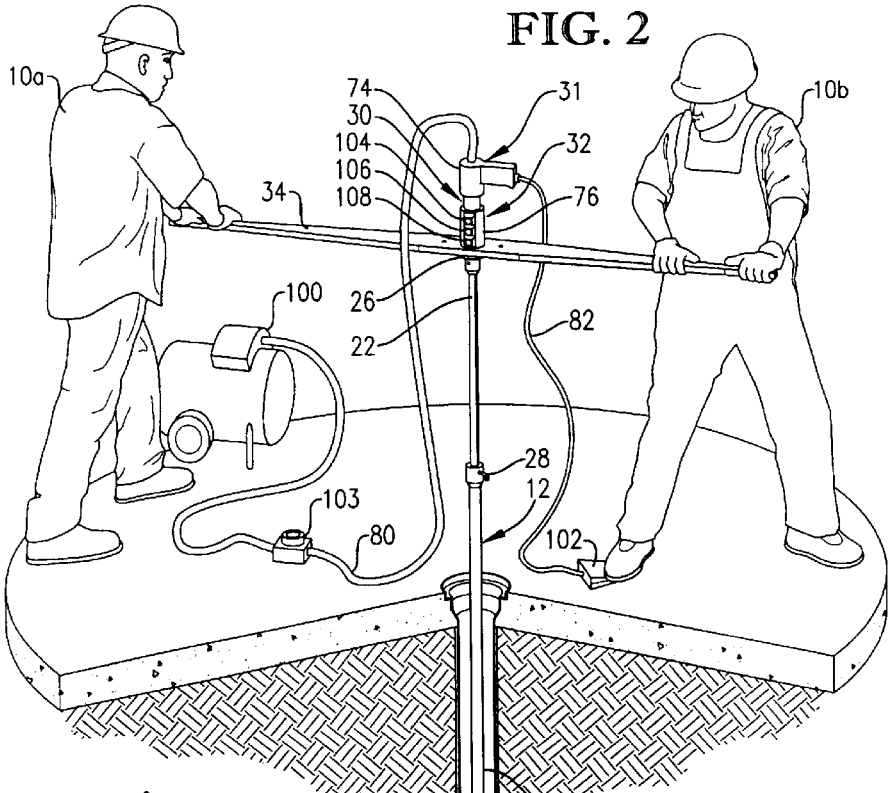
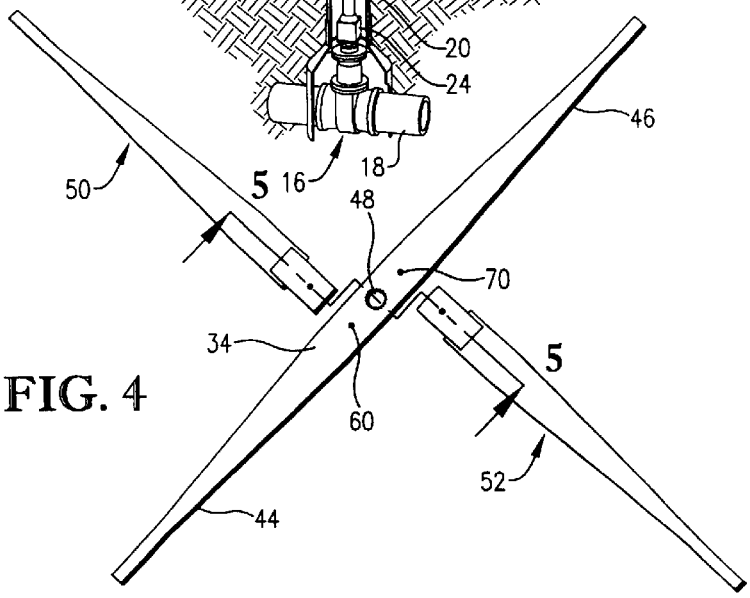
FIG. 4

VALVE OPERATOR

BACKGROUND OF INVENTION

1. Field of the Invention

The present invention relates generally to tools for opening and closing (i.e., exercising) valves. In another aspect, the invention concerns power valve operators for exercising valves having valve nuts that turn on a generally upright axis of rotation.

2. Description of the Prior Art

Many large valves are exercised by rotating a valve nut coupled to the body of the valve. Examples of valves that operate in this manner include valves employed in fire hydrants, underground water lines, water treatment plants, and petroleum product lines. Typically, such valves require a high magnitude of torque to rotate the valve nut. Further, such valves require relatively slow and constant turning of the valve nut in order to prevent damaging pressure surges upstream and downstream of the valve.

In the past, a variety of configurations of the manual and power valve operating devices have been employed to exercise valves via rotation of the valve nut. The prior art manual valve operators generally comprise a key for coupling the device to the valve nut and one or more elongated handles for increasing the amount of torque that can be manually applied to the valve nut. Although prior art manual valve operators are relatively inexpensive and portable, such manual devices have a number of drawbacks. For example, manually turning of the valve nut can be a slow and physically exhausting task, especially when the exercised valves require high torque and many rotations of the valve nut. When the valve is being closed in order to terminate flow to a damaged and leaking line, slow manual turning of the valve nut can allow excessive amounts of fluids to escape the leaking line during manual exercising of the valve, thereby risking further damage to the surroundings due to excessive fluid leakage. Physical exhaustion of the workers operating the manual valve operator can increase the risk of injury to the workers and/or increase the risk of worker error during performance of the desired task. When the valve being manually exercised is positioned in a dangerous location (e.g., an underground water valve accessible through a port in a city street), the slow valve-turning required by manual valve operators can increase the exposure of the workers to such dangerous conditions. In addition, the light weight of most manual valve operators creates a need for the workers to continually exert a downward holding force on the key while turning the valve nut in order to prevent disengagement of the key from the valve nut, which can become stripped (i.e., rounded-off) when the valve operator becomes disengaged during turning.

Prior art power (i.e., automatic) valve operators are typically mounted on vehicles. Such vehicle-mounted power valve operators can deliver high magnitudes of torque in a relatively rapid and continuous manner while exerting sufficient downward force on the key to maintain engagement of the key and the valve nut. However, vehicle-mounted power valve operators have a number of drawbacks. For example, such vehicle-mounted power valve operators are expensive to purchase and mount on the vehicle. Further, it can be very difficult to properly align the key of a vehicle-mounted power valve operator with the valve nut to be turned, especially when faced with adverse surface conditions such as, for example, snow, mud, and/or ice.

The prior art also includes portable (i.e., non vehicle-mounted) power valve operators. Such portable power valve operators typically are fairly lightweight and do not produce a sufficient amount of torque to exercise larger valves. Further, the light weight of these portable devices can cause the key to become disengaged from the valve nut unless a continuous manual downward force is exerted on the key by the workers operating the device.

SUMMARY OF INVENTION

It is, therefore, an object of the present invention to provide a portable valve operator that minimizes physical fatigue of workers operating the device.

A further object of the invention is to provide a power valve operator that can exercise valves more rapidly than manual means.

A still further object of the invention is to provide a portable valve operator having sufficient weight to prevent disengagement of the key from the valve nut without requiring application of a manual external downward force to the valve operator.

Another object of the invention is to provide a valve operator producing a relatively smooth and slow rotation that prevents pressure surges upstream and downstream of the valve when the valve is exercised.

Still another object of the invention is to provide a portable power valve operator operable to generate a sufficient amount of torque to operate large valves.

Yet another object of the invention is to provide a power valve operator that facilitates easy manual alignment of the key with the valve nut.

Yet still another object of the invention is to provide an improved method of exercising a valve using a power valve operator.

It should be understood that the above-listed objects are only exemplary, and not all the objects listed above need be accomplished by the invention described and claimed herein.

Accordingly, in one embodiment of the present invention, there is provided a tool for rotating a valve nut. The tool comprises an elongated key, a powering device, and a weighted handle. The key has a first end adapted to matingly engage the valve nut. The powering device includes a housing and a rotation element. The rotation element is drivingly coupled to the second end of the key. The powering device is operable to cause rotation of the rotation element relative to the housing. The handle is rigidly coupled to the housing and extends generally outwardly from the axis of elongation of the key. The handle has a center of gravity that is at least substantially centered on the axis of elongation of the key.

In another embodiment of the present invention, there is provided a valve operator for rotating a valve nut of a valve to thereby exercise the valve. The valve operator comprises an elongated key and a powering assembly. The elongated key presents a normally lower end for releasably and matingly engaging the valve nut. The powering assembly presents a rotation element adapted to releasably and matingly engage a normally upper end of the key. The powering assembly includes a powering device and a handle. The powering device is operable to rotate the rotation element relative to the handle. The powering assembly has a center of gravity that is at least substantially centered on the axis of rotation of the rotation element.

In still another embodiment of the present invention, there is provided a method of operating a valve having a valve nut that can be rotated on a generally upright axis of rotation to thereby exercise the valve. The method comprises the steps of: (a) coupling a normally lower end of an elongated key to the valve nut; (b) while the key is coupled to the valve nut, coupling a powering assembly to a normally upper end of the key, said powering assembly including a powering device and a handle; and (c) actuating the powering device to thereby cause the key and the valve nut to rotate relative to the handle.

In yet another embodiment of the present invention, there is provided a method of operating a valve having a valve nut that can be rotated on a generally upright axis of rotation to thereby exercise the valve. The method comprises the steps of: (a) coupling a key of a power valve operator to the valve nut; (b) substantially aligning the center of gravity of the power valve operator with the axis of rotation of the valve nut; and (c) simultaneously with step (b), using the power valve operator to rotate the valve nut.

BRIEF DESCRIPTION OF DRAWINGS

A preferred embodiment of the present invention is described in detail below with reference to the attached drawing figures, wherein:

FIG. 2 is a side view of a power valve operator constructed in accordance with the principles of the present invention being used to exercise an underground water valve, particularly illustrating the manner in which the valve operator is positioned over the valve nut and restrained from twisting by workers holding handles of the valve operator;

FIG. 4 is a top assembly view of the main and auxiliary handles of the valve operator;

DETAILED DESCRIPTION

Figure 1:
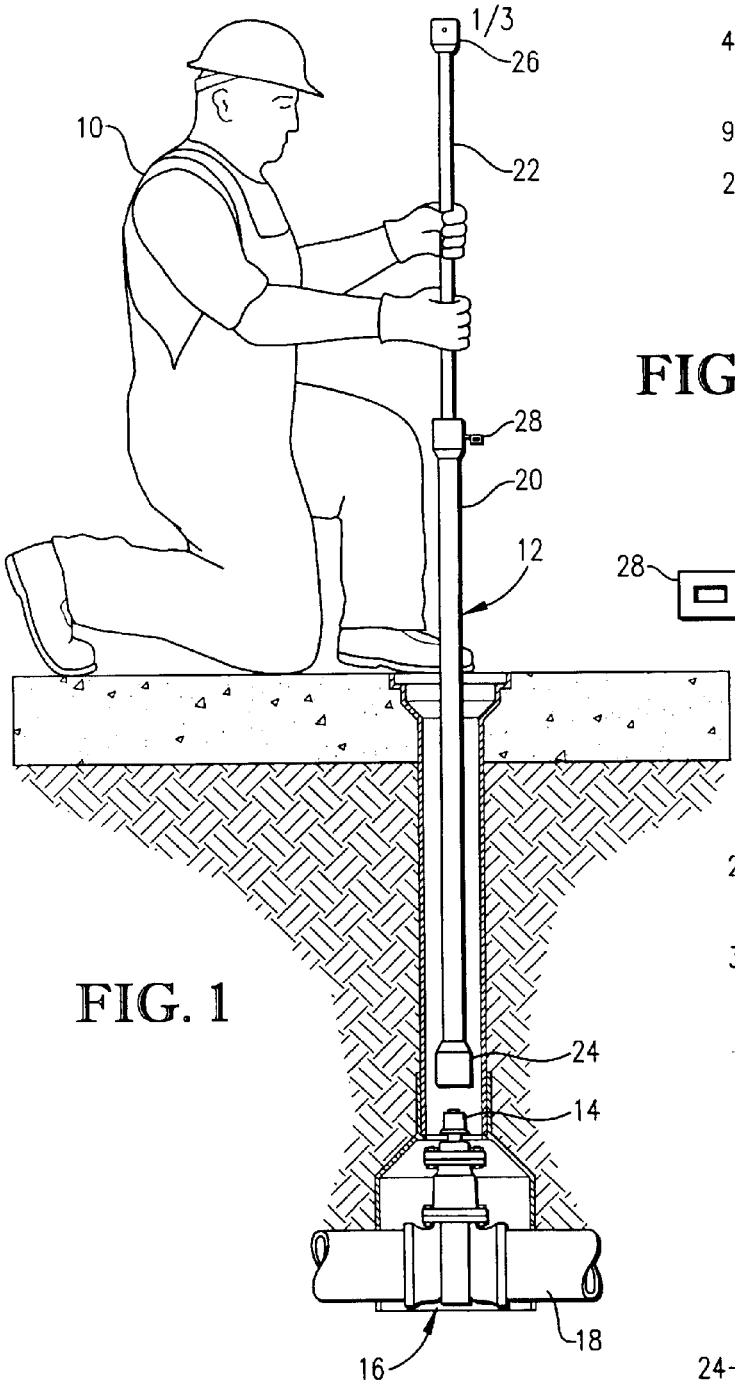
FIG. 1 is a side view of an extendable key being aligned for engagement with a valve nut of an underground water valve.

Referring initially to FIG. 1, a worker 10 is illustrated as manually aligning and lowering an elongated key 12 into engagement with a valve nut 14 of a valve 16 that controls flow through an underground water line 18. As used herein, the term "valve nut" shall denote any element that can mate with a key and causes opening or closing of the valve when rotated relative to the body of the valve. Elongated key 12 includes a first normally lower component 20 and a second normally upper component 22. First component 20 presents a normally lower end 24 that is adapted to releasably and matingly engage valve nut 14. Second component 22 presents a normally upper end 26 that is adapted to releasably and matingly engage a rotation element of a powering assembly to be described in detail below. First and second components 20, 22 are telescopically interfitted so that the distance between normally lower end 24 and normally upper end 26 can be adjusted by manually manipulating adjustment pin 28 and sliding first and second components 20, 22 relative to one another.

Referring to FIG. 2, once key 12 is positioned with normally lower end 24 matingly engaging valve nut 14, a powering assembly 30 can be coupled to normally upper end 26 of key 12. FIG. 2 shows an assembled inventive power valve operator 31 (comprising key 12 and powering assembly 30) positioned for turning valve nut 14 of valve 16. Powering assembly 30 generally includes a powering device 32 and a handle 34. Powering assembly 30 is operable to rotate key 12 relative to a handle 34 to thereby turn valve nut 14. It is preferred for the axis of rotation of valve nut 14 to be substantially vertical and for the axis of elongation of key 12 to be substantially aligned with the axis of rotation of valve nut 14. It is further preferred for the center of gravity of powering assembly 30 to be substantially centered on the axis of elongation of key 12. Such a configuration allows key 12 and powering assembly 30 to be substantially balanced on valve nut 14 of valve 16 so that workers 10*a,b* need only maintain the balance in valve operator 31 on valve nut 14 and restrain rotation of valve operator 31 via handle 34 during exercising of valve 16.

In order to ensure that normally lower end 24 of key 12 maintains engagement with valve nut 14, it is preferred for the total weight of valve operator 31 (i.e., the combined weight of power assembly 30 and key 12) to be at least about 75 pounds, more preferably at least about 125 pounds, still more preferably at least about 175 pounds, and most preferably at least 200 pounds. Due to the fact that key 12 must be manually manipulated into engagement with valve nut 14 prior to coupling powering assembly 30 to key 12, it is preferred for key 12 to be relatively light to facilitate ease of manipulation of key 12 onto valve nut 14. Preferably, key 12 makes up less than about 75 percent of the total weight of valve operator 31, more preferably less than about 65 percent of the total weight of valve operator 31, and most preferably less than 50 percent of the total weight of valve operator 31. Preferably, key 12 weighs less than about 100 pounds, more preferably less than about 75 pounds, and most preferably less than about 50 pounds. Thus, after key 12 is positioned on valve nut 14, the bulk of the weight of valve operator 31 can be manually added via the coupling of powering assembly 30 to normally upper end 26 of key 12.

It is preferred for powering assembly 30 to have a weight of sufficient magnitude to ensure that normally lower end 24 of key 12 maintains engagement with valve nut 14; however, it is further preferred for the weight of powering assembly 30 to be sufficiently low to allow powering assembly 30 to be manually lifted and placed onto normally upper end 26 of key 12 after key 12 has been set on valve nut 14. Thus, it is preferred for the weight of powering assembly 30 to be in the range of from about 50 to about 800 pounds, more preferably in the range of from about 75 to about 600 pounds, still more preferably in the range of from about 100 to about 400 pounds, and most preferably in the range of from 150 to 300 pounds. Preferably powering assembly 30 makes up at least about 35 percent of the total weight of power operator 31, more preferably at least about 50 percent of the total weight of power operator 31, and most preferably at least 65 percent of the total weight of power operator 31. In order to prevent fatigue of workers 10*a,b* due to supporting excessive vertical loads, it is preferred for at least about 75 percent of the weight of powering assembly 30 to be supported by key 12, more preferably at least about 85 percent of the weight of powering assembly 30 is supported by key 12, and most preferably at least about 90 percent of the weight of powering assembly 30 is supported by key 12 when valve operator 31 is positioned for turning valve nut 14. The weight of powering assembly 30 supported by key 12 is directly transferred to valve nut 14 to thereby maintain engagement of key 12 and valve nut 14 during exercising of valve 16.

Handle 34 of powering assembly 30 preferably has a center of gravity that is at least substantially aligned with the axis of elongation of key 12. It is preferred for handle 34 to be weighted to thereby inertially counteract any sudden twisting or tilting of valve operator 31. Preferably, handle 34 weighs at least about 25 pounds, more preferably at least about 50 pounds, still more preferably at least about 75 pounds, and most preferably at least 100 pounds. Preferably, handle 34 makes up at least about 25 percent of the total weight of power operator 31, more preferably at least about 35 percent of the total weight of power operator 31, and most preferably at least 50 percent of the total weight of power operator 31.

Figure 3:
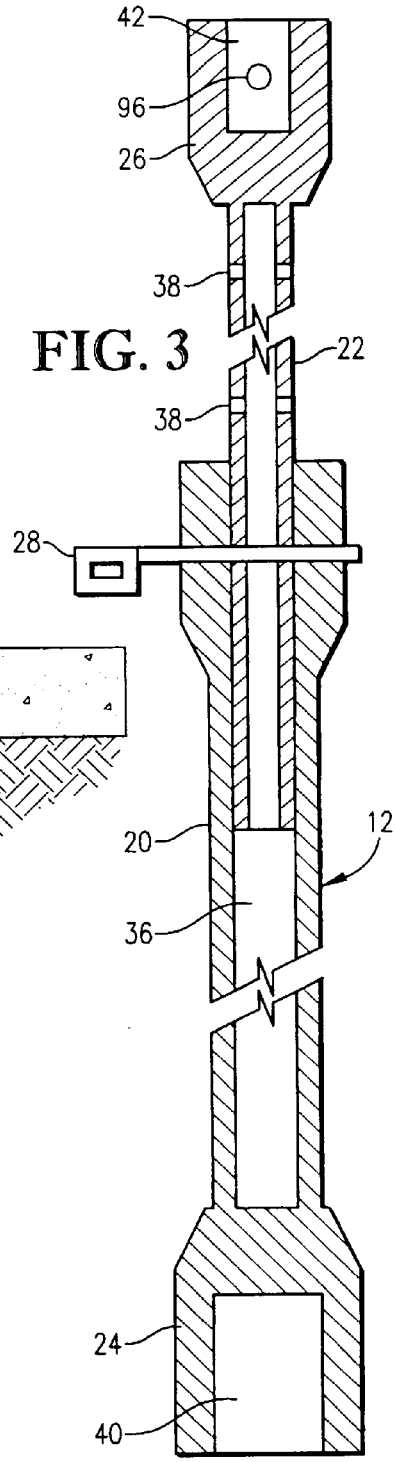
FIG. 3 is a sectional side view of the key that is configured to extend between the valve nut and the powering device during exercising of a valve, particularly illustrating the manner in which the length of the key can be adjusted.

Referring to FIG. 3, first component 20 of key 12 preferably defines a generally non-circular channel 36 within which second component 22 can be telescopically received. It is preferred for the outer surface of second component 22 to substantially match the generally non-circular shape of channel 36 so that relative twisting of first and second components 20, 22 is restrained. Preferably, channel 36 has a substantially equilateral polygonal shape, most preferably a substantially square shape. Second component 22 can include a plurality of adjustment holes 38 that allow the axial position of first and second components 20, 22 to be adjusted and fixed via manual manipulation of adjustment pin 28 in different adjustment holes 38. Normally lower end 24 defines a first socket 40 that is adapted to matingly and releasably engage valve nut 14. Normally upper end 26 defines a second socket 42 adapted to matingly and releasably engage a rotation element of powering assembly 30. It is preferred for key 12 to be adjustable up to a maximum length (i.e., maximum distance between normally lower end 24 and normally upper end 26) of at least about five feet, more preferably at least about eight feet, and most preferably at least 10 feet.

Figure 5:
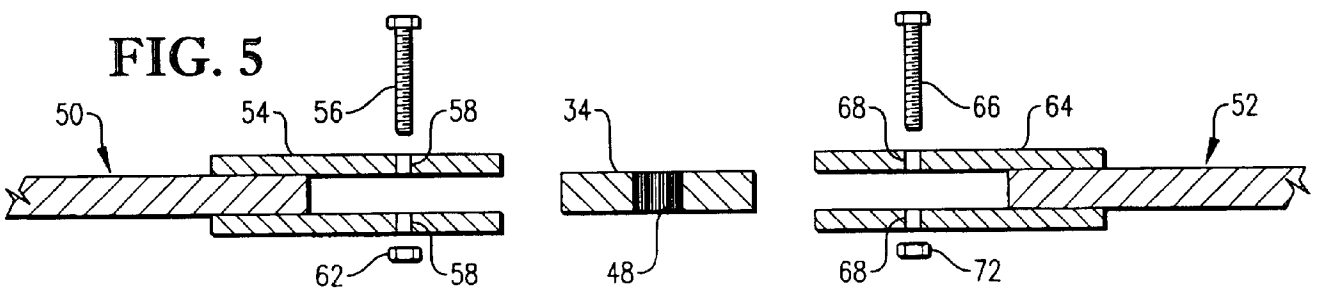
FIG. 5 is a partial side sectional assembly view of the valve operator handles, particularly illustrating the manner in which the auxiliary handles can be coupled to the main handle.

Referring to FIG. 4, main handle 34 includes an elongated first portion 44 and an elongated second portion 46 each extending in generally opposite directions from a splined opening 48 extending through handle 34. Referring to FIGS. 4 and 5, first and second auxiliary handles 50, 52 are configured to be coupled to main handle 34 in situations where more weight is required to force valve operator 31 down onto valve nut 14 or where more workers are required to resist twisting of valve operator 31. First auxiliary handle 50 can be releasably coupled to main handle 34 by placing a first connection fork 54 over main handle 34, extending a first connection bolt 56 through first auxiliary connection holes 58 and first main connection hole 60, and tightening first connection nut 62 onto first connection bolt 56. Second auxiliary handle 52 can be releasably coupled to main handle 54 by placing a second connection fork 64 over main handle 34, extending a second connection bolt 66 through second auxiliary connection holes 68 and second main connection hole 70, and tightening second connection nut 72 on second connection bolt 66. It is preferred for first and second auxiliary handles 50, 52 to extend in generally opposite directions that are at least substantially perpendicular to the direction of extension of first and second portions 44, 46 of main handle 34. Preferably, each of first auxiliary handle 50, second auxiliary handle 52, first portion 44, and second portion 46 has a length in the range of from about two to about eight feet, more preferably in the range of from about three to about six feet, and most preferably in the range of from 3.5 to 4.5 feet.

Figure 6:
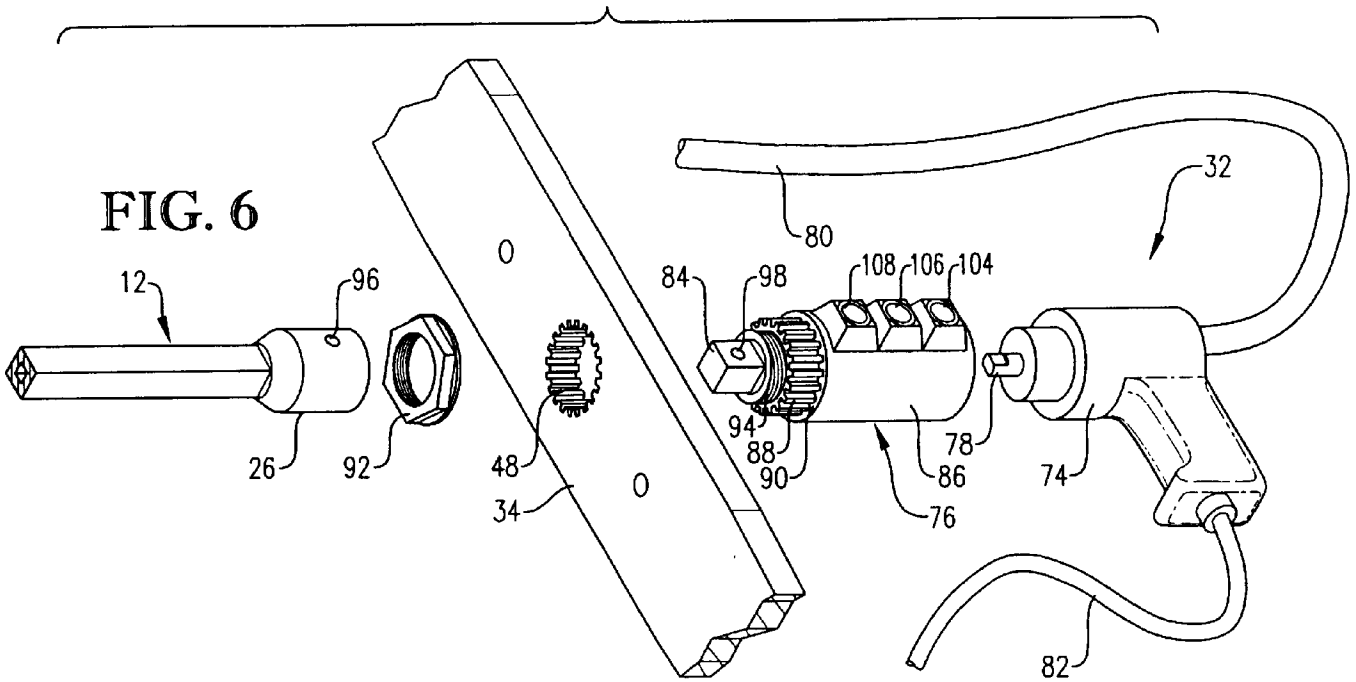
FIG. 6 is an isometric assembly view showing the manner in which the key, the handle, the torque converter, and the motor of the power operator are interconnected.

Referring to FIG. 6, powering device 32 is illustrated as comprising a motor 74 and a torque converter 76. One example of a commercially available device that can be employed as powering device 32 is known in the art as a "nutrunner." Suitable nutrunners are manufactured by ROTORTOOL® and are available from Cooper Tools, Lexington, S.C. Motor 74 includes an output shaft 78 providing substantially high speed and low torque rotary output. Motor 74 can be either a hydraulic, pneumatic, or electric motor. Preferably, motor 74 is a pneumatic motor powered via air supplied through air supply hose 80. The speed and torque of motor 74 can be controlled via signals transmitted through a control line 82. In an alternative embodiment of the present invention, motor 74 can be replaced with a combustion engine.

Torque converter 76 has a housing 86 that is rigidly coupled to the housing of motor 74. Torque converter 76 also includes internal torque conversion components that are coupled to output shaft 78. Torque converter 76 is operable to increase the torque and reduce the speed of the rotary output from output shaft 78. The resulting low speed, high torque rotary output of torque converter 76 is conveyed via a rotation element 84 which rotates relative to housing 86 of torque converter 76. It is preferred for powering device 32 (i.e., motor 74 and torque converter 76) to be operable to produce at least about 500 foot-pounds of torque between housing 86 and rotation element 84, more preferably at least about 750 foot-pounds of torque, still more preferably at least about 1,000 foot-pounds of torque, and most preferably at least 1,250 foot-pounds of torque. It is preferred for powering device 32 to be operable to rotate rotation element 84 relative to housing 86 at a speed in the range of from about 0.5 to about 40 rpm while delivering the required amount of torque, more preferably a speed in the range of from about 1.0 to about 20 rpm, and most preferably a speed in the range of from 5 to 15 rpm.

Handle 34 can be easily coupled and decoupled from powering device 32. To couple handle 34 to powering device 32, splined opening 48 in handle 34 is placed over a corresponding splined projection 88 of housing 86 and against a flange 90 of housing 86. A female threaded collar 92 can then be threaded onto a corresponding male threaded projection 94 of housing 86 and tightened into contact with main handle 34 to thereby secure handle 34 between collar 92 and flange 90. To couple powering device 32 to normally upper end 26 of key 12, rotation element 84 can be inserted into second socket 42 (shown in FIG. 3) of normally upper end 26 to form a releasable mating connection that restricts relative rotation of key 12 and rotation element 84. Typically the weight of powering assembly 30 is sufficiently large to maintain engagement of rotation element 84 and upper end 26 of key 12 when valve operator 31 is positioned for rotating valve nut 14 (see FIG. 2). However, if it is desired to further secure the connection between key 12 and rotation element 84, a pin (not shown) can be inserted through a hole 96 in normally upper end 26 of key 12 and through an opening 98 in rotation element 84, thereby locking key 12 and rotation element 84 into engagement with one another.

Referring now to FIGS. 1 and 2, in operation, key 12 is manually coupled to valve nut 14 so that rotation of key 12 causes corresponding rotation of valve nut 14. The length (i.e., height) of key 12 can then be adjusted so that upper end 26 of key 12 is at an appropriate height for placement of powering assembly 30 thereon. Powering assembly 30 is then placed on and coupled to normally upper end 26 of key 12 by inserting rotation element 84 (shown in FIG. 6) into second socket 42 (shown in FIG. 3). In such a configuration (shown in FIG. 2) the axis of rotation of valve nut 14, the axis of elongation of key 12, the axis of rotation of rotation element 84, and the center of gravity of powering assembly 30 are all substantially vertically aligned. This vertical alignment and weight distribution allows the center of gravity of valve operator 31 to be positioned over valve nut 14 so that valve operator 31 is substantially balanced on valve nut 14 during exercising of valve 16. Prior to rotating valve nut 14, motor 74 of powering assembly 30 must be coupled to a power source 100 (such as an air compressor) that provides power to motor 74 via air supply hose 80. Handle 34 of powering assembly 30 can then be grasped by workers 10*a,b*. While handle 34 is manually grasped by workers 10*a,b*, worker 10*b* can depress a foot actuator 102 that is connected to motor 74 via control line 82. Foot actuator 102 is operable to actuate motor 74, thereby causing rotation of key 12 relative to handle 34. Foot actuator 102 can also include controls for varying the speed and torque of powering device 32. While valve operator 31 is employed to rotate the valve nut 14, worker 10*a* can monitor a pressure gauge 103 disposed in air supply hose 80 to ensure that proper air pressure is supplied to motor 74. Further, during operation of valve operator 31, worker 10*b* can monitor the torque, speed, and number of revolutions of key 12 relative to handle 34 via a torque gauge 104, an rpm gauge 106, and an automatic resettable cycle counter 108, respectively.

The preferred forms of the invention described above are to be used as illustration only, and should not be used in a limiting sense to interpret the scope of the present invention. For example, although FIGS. 1 and 2 illustrate the exercised valve as being an underground water line valve, it is entirely within the ambit of the present invention for the valve operator to be used to exercise above-ground valves such as, for example, valves employed in fire hydrants, water treatment plants, or petroleum product lines. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A tool for rotating a valve nut, said tool comprising:

an elongated key having first and second ends, said first end being adapted to matingly engage the valve nut;

a powering device including a housing and a rotation element, said rotation element being drivingly coupled to the second end of the key, said powering device being operable to cause rotation of the rotation element relative to the housing; and a weighted handle rigidly coupled to the housing and extending generally outwardly from an axis of elongation of the key, said handle having a center of gravity that is at least substantially centered on the axis of elongation of the key.

2. A tool according to claim 1, said handle including a first elongated portion extending in a first direction and a second elongated portion extending in a second direction that is generally opposite the first direction.

3. A tool according to claim 2, said first and second elongated portions each having a length of at least about two feet.

4. A tool according to claim 3, said handle weighing at least about 25 pounds, said handle accounting for at least about 25 percent of the total weight of the tool.

5. A tool according to claim 3, said handle including a third elongated portion extending in a third direction and a fourth elongated portion extending in a fourth direction that is generally opposite the third direction.

6. A tool according to claim 5, said first and third directions being substantially perpendicular to one another, said third and fourth elongated portions of the handle being readily detachable from the first and second elongated portions of the handle.

7. A tool according to claim 5, said first, second, third, and fourth elongated portions of the handle each having a length of at least about three feet, said first, second, third, and fourth directions each being substantially perpendicular to the axis of elongation of the key, said handle weighing at least about 50 pounds, said handle accounting for at least about 35 percent of the total weight of the tool.

8. A tool according to claim 1, said handle being releasably coupled to the housing via a splined connection that restrains rotation of the handle relative to the housing.

9. A tool according to claim 1, said valve nut having an axis of rotation that is at least generally vertical in orientation, said key, handle, and powering device having a combined center of gravity that is at least substantially aligned with the axis of rotation of the valve nut when the first end of the key matingly engages the valve nut.

10. A tool according to claim 1, said axis of elongation of the key being at least substantially aligned with the axis of rotation of the valve nut when the key matingly engages the valve nut, said axis of elongation of the key being at least substantially aligned with the axis of rotation of the rotation element.

11. A tool according to claim 1, said key including first and second telescopically interfitted components, said key having a length between the first and second ends of the key that is adjustable via the relative sliding of the first and second components.

12. A tool according to claim 11, said key being adjustable to a maximum length of at least about five feet.

13. A tool according to claim 1, said powering device being pneumatically, hydraulically, or electrically powered, said powering device being operable to generate at least 500 foot-pounds of torque between the housing and the rotation element while rotating the rotation element relative to the housing at a speed in the range of from about 0.5 to about 40 rpm.

14. A tool according to claim 1, said powering device including a pneumatic motor and a torque converter, said motor having a rotary output shaft, said torque converter being coupled to the output shaft, said torque converter being operable to reduce the speed and increase the torque of the rotary output from the output shaft of the motor, said torque converter including the rotation element and the housing, said powering device being operable to generate at least about 750 foot-pounds of torque between the housing and the rotation element while rotating the rotation element relative to the housing at a speed in the range of from about 1.0 to about 20 rpm.

15. A tool according to claim 1; and a foot actuator spaced from and physically manipulable relative to the powering device, said actuator being operable to actuate the powering device when the actuator is contacted.

16. A tool according to claim 1; and an automatic cycle counter operable to measure and display the number of rotations of the rotation element relative to the housing.

17. A tool according to claim 1, said tool having a total weight of at least about 125 pounds, said handle accounting for at least about 35 percent of the total weight of the tool, said key accounting for less than about 65 percent of the total weight of the tool.

18. A tool according to claim 1, said tool having a total weight of at least about 175 pounds, said handle weighing at least about 50 pounds, said key weighing less than about 75 pounds.

19. A valve operator for rotating a valve nut of a valve to thereby exercise the valve, said valve nut being rotatable about an axis of rotation that is at least generally vertical in orientation, said valve operator comprising:

an elongated key presenting a normally lower end and a normally upper end, said normally lower end being adapted to releasably and matingly engage the valve nut; and a powering assembly presenting a rotation element adapted to releasably and matingly engage the normally upper end of the key, said powering assembly including a powering device and a handle, said powering device being operable to rotate the rotation element relative to the handle, said powering assembly having a center of gravity that is at least substantially centered on the axis of rotation of the rotation element.

20. A valve operator according to claim 19, said powering assembly having a weight of at least about 50 pounds, said valve operator being configured so that at least 75 percent of the weight of the powering assembly is supported by the key when the key matingly engages the valve nut and the rotation element.

21. A valve operator according to claim 19, said powering assembly being operable to produce at least 500 foot-pounds of torque between the handle and the rotation element at a speed in the range of from about 0.5 to about 40 rpm.

22. A valve operator according to claim 21, said powering device including a rotary pneumatic motor and a torque converter, said torque converter being operable to reduce the speed and increase the torque of the rotary output from the motor, said torque converter including the rotation element and a housing to which the handle is rigidly coupled.

23. A valve operator according to claim 22, said powering assembly being operable to produce at least 750 foot-pounds of torque between the handle and the rotation element at a speed in the range of from about 1.0 to about 20 rpm.

24. A valve operator according to claim 19, said key having an axis of elongation that is at least substantially aligned with the axis of rotation of the valve nut when the key and the valve nut matingly engage one another, said handle including first and second elongated portions extending outwardly from the axis of elongation of the key in generally opposite directions.

25. A valve operator according to claim 24, said first and second elongated portions of the handle each extending at least two feet out from the axis of elongation of the key.

26. A valve operator according to claim 25, said first and second elongated portions of the handle each extending in the range of from about three to about six feet out from the axis of elongation of the key, said handle weighing at least 25 pounds.

27. A valve operator according to claim 19, said key comprising first and second telescopically interfitted components, said key having a length between the normally upper and lower ends that is adjustable via relative sliding of the first and second components, said key being extendable to a maximum length of at least about five feet.

* * * * *